United States Patent [19]

Moffett

[11] Patent Number: 4,574,600

[45] Date of Patent: Mar. 11, 1986

[54] HANDCUFF AND LOCK THEREFOR

[75] Inventor: Warren Moffett, East Longmeadow, Mass.

[73] Assignee: Bangor Punta Corporation, Greenwich, Conn.

[21] Appl. No.: 548,259

[22] Filed: Nov. 2, 1983

[51] Int. Cl.[4] ..... E05B 75/00

[52] U.S. Cl. ..... 70/16

[58] Field of Search ..... 70/15–17, 70/346, 347, 409

[56] References Cited

U.S. PATENT DOCUMENTS

| | | | |
|---|---|---|---|
| 1,821,566 | 9/1931 | Neal | 70/16 |
| 1,845,511 | 2/1932 | Neal | 70/16 |
| 2,388,766 | 11/1945 | Ruttiman | 70/16 |
| 4,287,731 | 9/1981 | Kruger | 70/16 |
| 4,289,001 | 9/1981 | Corfield | 70/409 X |

*Primary Examiner*—Robert L. Wolfe

*Attorney, Agent, or Firm*—Patrick J. Walsh

[57] ABSTRACT

Disclosed is a handcuff having a pair of cheeks and jaw pivotally secured one to the other and movable between handcuff open and closed positions. The cheeks carry a lock assembly including a pivotally mounted bolt for locking the jaw and cheeks one to the other in the handcuff closed position and a leaf spring for biasing the bolt for movement into its locking position, the spring carrying a detent. The spring is slidable between a first position with the detent offset from the bolt to enable the bolt to move against the bias of the spring to unlock the jaw and a second position locating the detent in registry with the bolt to maintain the bolt in its locked position thus double locking the handcuff. A keyhole is provided through one of the cheeks and receives a bushing. The bushing terminates short of the other cheek and is disposed about a pin secured to the other cheek. Thus bolt head includes a shoulder located between the end of the bushing and the one cheek. The remaining part of the bolthead end between the bushing end and the other cheek is recessed or set back from the shoulder. Thus, direct access to the shoulder through the keyhole opening is prevented.

2 Claims, 6 Drawing Figures

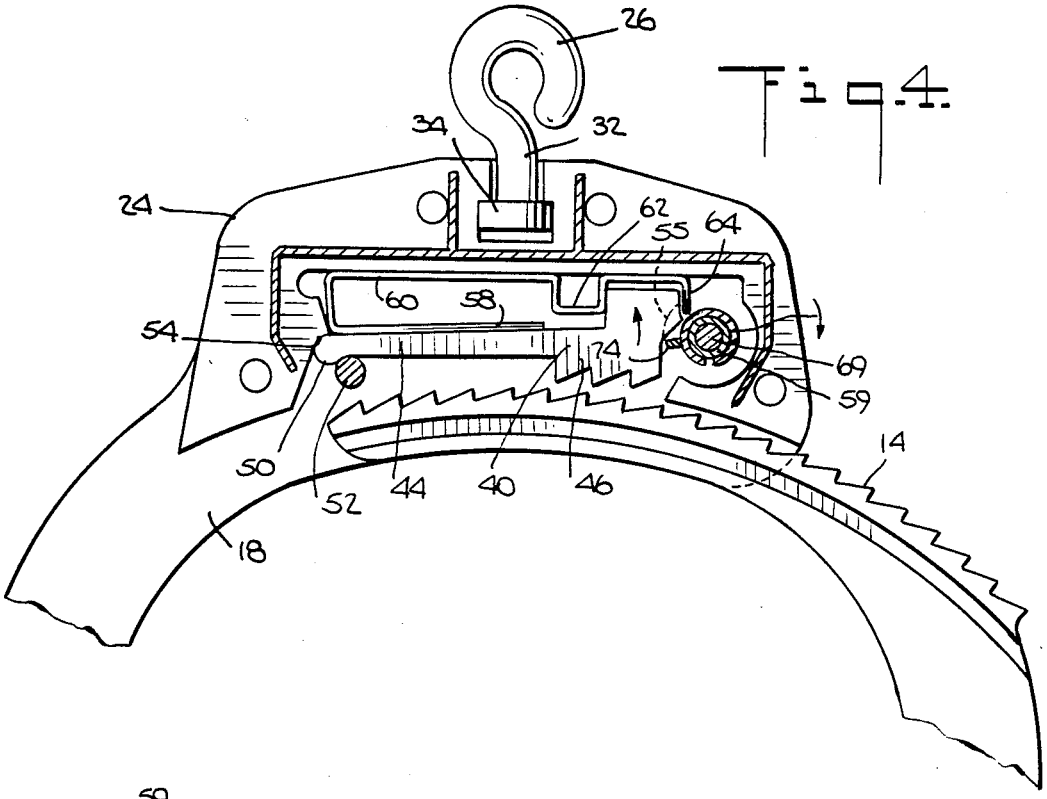
Fig. 4.
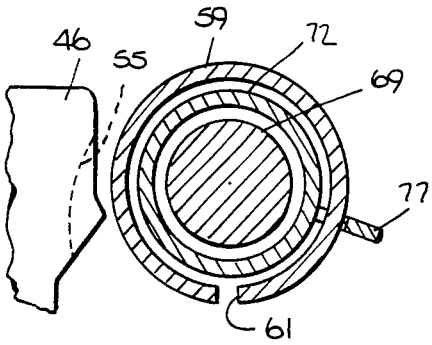
Fig. 6.
Fig. 5.
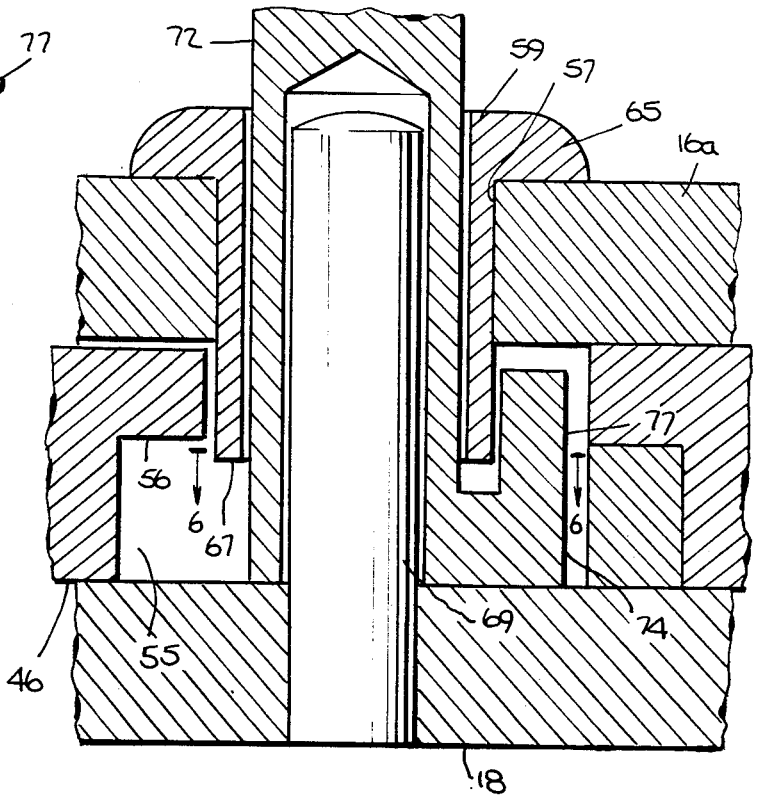

HANDCUFF AND LOCK THEREFOR

BACKGROUND OF THE INVENTION

The present invention relates to handcuffs for locking about the wrists of individuals and more particularly relates to a handcuff having improved protection against picking the lock of the handcuff.

The present invention constitutes an improvement to the handcuffs disclosed in U.S. Pat. No. 4,287,731 issued of common assignee herewith. In that patent, the handcuffs include a generally arcuate jaw having ratchet teeth at one end and pivotally coonnected at its opposite end between a pair of spaced cheeks. The cheeks are enlarged at their opposite ends and a lock assembly is enclosed therebetween. Briefly, the lock assembly includes a bolt having ratchet teeth along one side and pivoted at one end between a locked position engaging the ratchet teeth of the jaw and an unlocked position with the ratchet teeth spaced from the ratchet teeth of the jaw. A spring biases the bolt into its locked position and is also slidable into a bolt detenting position to double lock the bolt. In using these handcuffs, a key with a lateral projection at one end is inserted into a key opening in one of the cheeks. Upon rotation of the key in one direction, it slides the spring from its double locking position. Upon rotation of the key in the opposite direction, the key lifts the bolt from locking engagement with the jaw.

While the above described handcuffs have proven satisfactory, it is still possible for the lock to be picked. For example, in practice the double lock may not be utilized leaving only the bolt under the bias of the spring in locking engagement with the jaw. It is possible to insert a pin having a lateral projection on its end, or a bent paperclip, into the keyhole to engage the locking shoulder on the bolt and lift the bolt from its locking position. Even when double locked, an individual knowledgeable in the construction and operation of the handcuff lock may be able to first slide the spring from its double locking position and thereafter lift the bolt from its locked position. Accordingly, there has arisen a need to provide in a handcuff of this type additional protection against picking the handcuff lock.

SUMMARY OF THE PRESENT INVENTION

It is a primary object of the present invention to provide a novel and improved handcuff lock having improved protection against picking the handcuff lock.

It is another object of the present invention to provide a novel and improved handcuff lock which effectively prevents opening the handcuff by insertion of tools or other instruments into the keyhole of the handcuff lock.

It is still another object of the present invention to provide a novel and improved handcuff lock which retains the double locking features of the above discussed handcuffs while affording additional protection against the lock being picked.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the foregoing and other objects and advantages and in accordance with the purposes of the present invention, as embodied and broadly described herein, a handcuff constructed in accordance with the present invention may comprise generally arcuate front and back cheeks spaced one from the other and carrying a lock assembly therebetween at one end, a generally arcuate jaw having teeth at one end, means for pivotally coupling the cheeks and the jaw one to the other at their respective opposite ends to enable relative pivotal movement of the cheeks and the jaw toward and away from one another between handcuff closed and open positions, respectively, the lock assembly including a bolt between the cheeks having teeth and pivotal between a locking position with its teeth engaging the teeth carried by the jaw to prevent relative movement of the cheeks and the jaw away from one another toward the handcuff open position and an unlocking position with its teeth spaced from the teeth carried by the jaw to enable relative movement of the cheeks and the jaw away from one another toward the handcuff open position, and a bolt spring carried by the lock assembly having a portion engageable with the bolt to bias the bolt for movement toward its locking position, one of the cheeks having an opening through a wall thereof for receiving the end of a key, a generally cylindrical bushing disposed in the opening with its inner end terminating short of the other of the cheeks, the bolt having a bolt end with a shoulder engageable by the key end for displacing the bolt from its lock position toward its unlocked position upon rotation of the key, the shoulder being located in the space between the cheeks and between the inner end of the bushing and the one cheek, the remaining portion of the bolt end between the inner end of the bushing and the other of the cheeks being recessed away from the bushing thereby preventing direct access to the shoulder through the key opening.

The accompanying drawings which are incorporated in and constitute a part of this specification, illustrate one embodiment of the present invention and, together with the description, serve to explain the principles of the invention.

BRIEF DESCRIPTION OF THE DRAWINGS

FIG. 4 is a view similar to FIG. 3 illustrating the locking assembly in an unlocked condition;

FIG. 5 is an enlarged cross sectional view of the key opening and lock assembly illustrated in FIG. 1 taken generally about on line 5—5 in FIG. 1; and FIG. 6 is an enlarged cross sectional view of the key opening and lock assembly taken generally about on line 6—6 in FIG. 5.

DESCRIPTION OF A PREFERRED EMBODIMENT

Reference will now be made in detail to the preferred embodiment of the present invention, an example of which is illustrated in the accompanying drawings.

Figure 1:
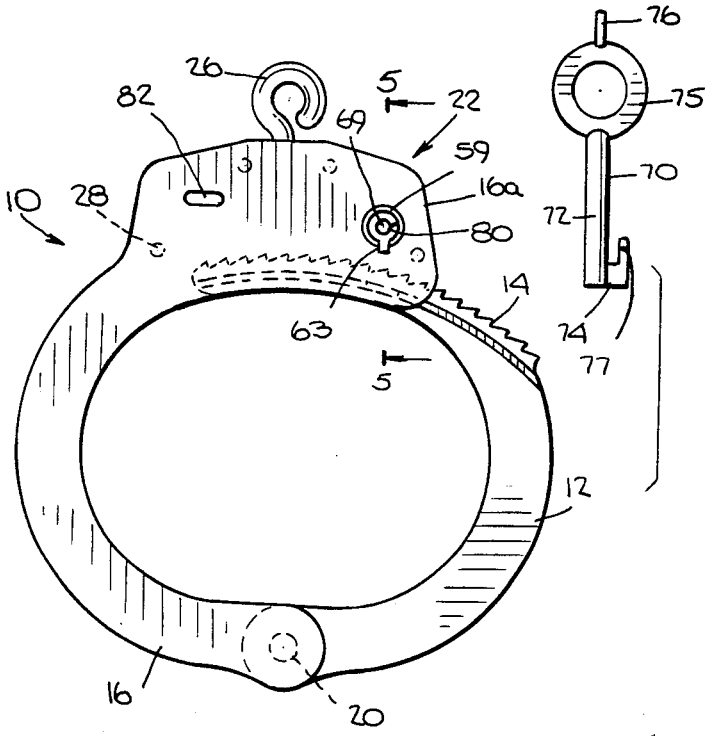
FIG. 1 is a side elevational view of a handcuff constructed in accordance with the present invention and further illustrating a key therefor.
Figure 2:
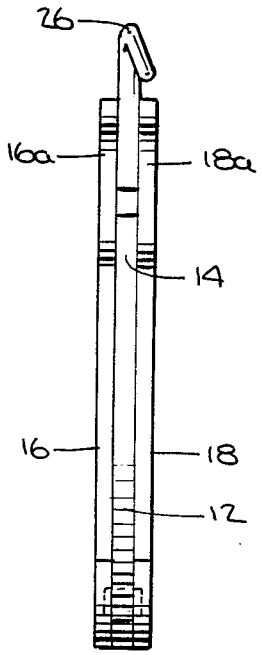
FIG. 2 is an end elevational view of the handcuff illustrated in FIG. 1.

Referring now to FIGS. 1 and 2, there is illustrated a handcuff constructed in accordance with the present invention and generally designated 10, it being appreciated that only one such handcuff normally comprising a pair thereof chained one to the other is described and illustrated herein. Handcuff 10 includes a generally arcuate jaw 12 having ratchet-like teeth 14 at one end and pivotally connected at its opposite end between generally arcuate front and back cheeks 16 and 18, respectively. This pivotal connection includes a joint stud 20 suitably secured in recesses formed in the opposed and registering end of cheeks 16 and 18 and an aperture through jaw 12. Cheeks 16 and 18 terminate at their opposite ends in enlarged heads 16*a* and 18*a* which form part of the lock assembly, generally indicated 22. Lock assembly 22 includes a frame 24, preferably a metal plate, disposed between cheek heads 16*a* and 18*a*. As illustrated, frame 24 has the same general outline as the cheek heads which straddle frame 24. A swivel 26 is secured to the frame and cheek head and projects therefrom for attachment to a chain, not shown, in a conventional manner.

Figure 3:
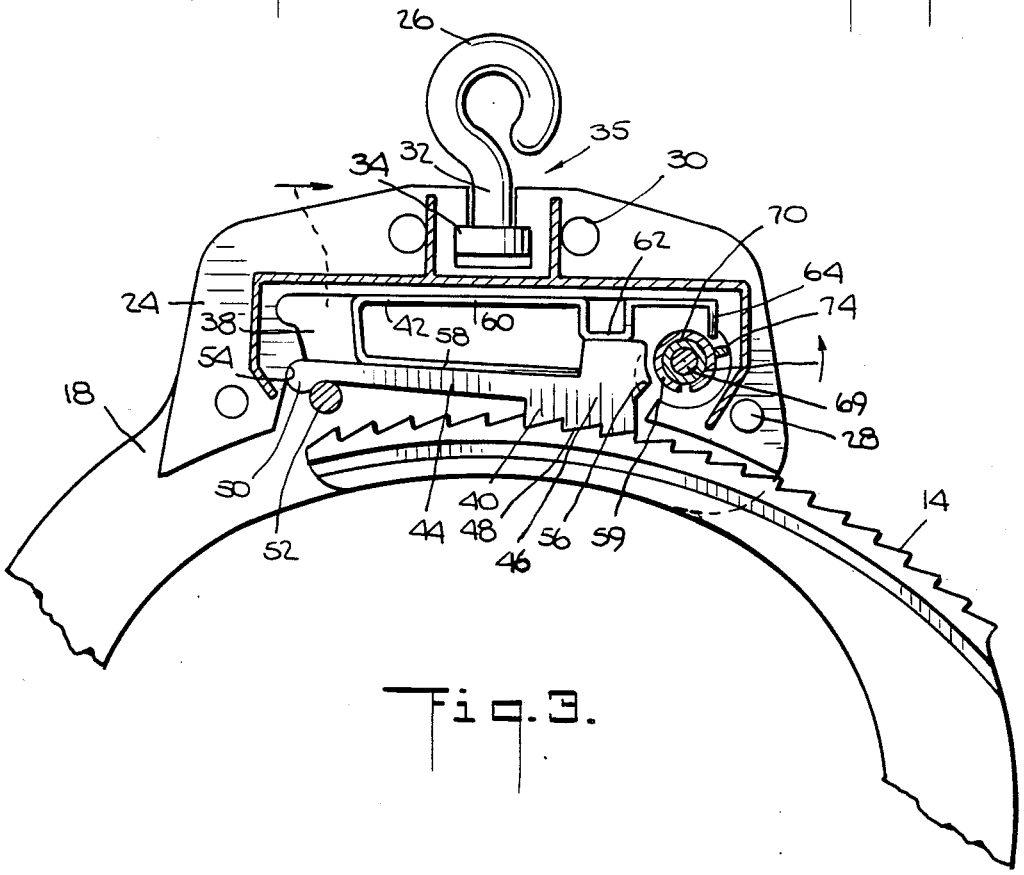
FIG. 3 is a fragmentary enlarged view of the handcuff with the front cheek removed and illustrating the lock assembly of the handcuff in its double locked condition.

To obtain increased strength in the construction of lock assembly 22 and the joining of the cheek heads and frame one to the other, each cheek head is provided with a plurality of inwardly extending bosses or protrusions 28 which are received in registering apertures 30 formed in frame 24. In forming frame 24, a generally T-shaped slot 35 is provided through its top to receive the shank and base portions 32 and 34, respectively, of swivel 26. To accommodate the enlarged width of the base 34, the interiors faces of cheeks 16*a* and 18*a* registrable with base 34 upon final assembly are recessed at 36, as best illustrated in FIG. 3, to receive the margins of base 34 which exceed the width of frame 24. Frame 24 is formed to provide a recess along its underside and defines, with the sides of cheek heads 16*a* and 18*a*, a chamber or cavity 38 housing the working parts of lock assembly 22. In final assembly, the cheek heads and frame 24 are alined and brazed one to the other with the bosses 28 received in the registering apertures 30 and base portion 34 of swivel 26 in the base of T-shaped slot 35.

Lock assembly 22 includes a bolt 40 and a bolt spring 42 both disposed in cavity 38. Bolt 40 comprises an elongated shank 44, a head 46 having teeth 48 along its underside for engaging the teeth 14 carried by jaw 12, and an enlarged generally cylindrical hub 50 at its end remote from head 46. Bolt 40 is pivotally secured to the cheeks and frame by a stud 52 secured between cheek heads 16*a* and 18*a* and a spaced recess 54 on frame 24. Particularly, stud 52 extends below hub 50 and provides a pivotal support therefor. Recess 54 is defined by a circular wall portion which lies on the opposite side of hub 50 from stud 52. Thus stud 52 and wall 54 define a bearing for hub 50 and about which bolt 40 pivots. For reasons discussed hereinafter, the forward edge of head 46 of bolt 40 is recessed along one side thereof at 55 and carries a shoulder 56 along its opposite side.

Bolt spring 42 comprises an elongated strip of metal reversely formed, e.g., intermediate its ends to provide first and second spring leg portions 58 and 60, respectively. When bolt spring 42 is disposed is cavity 38 as best illustrated in FIGS. 3 and 4, first spring leg portion 58 bears against shank 44 of bolt 40 to bias it for pivotal movement in a clockwise direction tending to move the bolt into a locking position with teeth 48 engaging teeth 14 of jaw 12. Second spring leg portion 60 bears against the base of cavity 38; e.g., the underside of frame 24. Second spring leg portion 60 also carries a detent 62 for locking bolt 40 in its locked position. Particularly, second spring leg portion 60 is formed; e.g., bent, intermediate its length to provide a generally U-shaped spring leaf portion extending toward first spring leg portion 58 for engagement with the top of head 46 in a manner described in detail hereinafter. The distal end or tip of second spring leg portion 60 is formed; e.g., bent, to terminate in a shoulder or flange 64 and which flange 64 extends in a direction toward first spring leg portion 50.

Bolt spring 42 is carried for linear sliding movement lengthwise within cavity 38 between first and second positions, respectively. Particularly, the first spring leg portion 58 is adapted to slide among the flat upper face of shank 44 of bolt 40. Second spring leg portion 60 is slidable along the flat underside of frame 24, the opposite ends of spring 42 butting the ends of frame 24 and defining the end limits of its linear displacement.

In accordance with the present invention, the improved lock assembly hereof includes a key opening 57 formed in cheek head 16*a*. A cylindrical bushing 59 is secured in key opening 57 and has an axially extending slot 61 and a radial slot 63 through its outer annular flange 65. As best illustrated in FIG. 5, the inner end 67 of bushing 59 terminates short of and is spaced from the opposite cheek 18 for reasons which will become clear from the ensuing description. A pin 69 is secured to cheek 18 and extends through bushing 59 terminating at its free end flush with the flange 65 of the bushing. The pin is smaller in diameter than the bushing leaving an annular space between the bushing and the pin. It will be appreciated from a review of FIG. 5 that the shoulder 56 is located between cheeks 16 and 18 between the inner end 67 of bushing 59 and the cheek 16. Further, the recess 55 formed on the bolt head 46 is located between the inner end 67 of bushing 59 and the other cheek 18. The bolt is thus spaced in the area of the recess a substantial distance back or away from the pin 69.

Referring now to FIG. 1, there is provided a key 70 having a shank or shaft 72 with a radial projection 74 at one end and a head 75 with an axial projection or pin 76 at its opposite end. The end of key 70 carrying projection 74 is axially recessed for engagement about pin 69. The projection 74 at one end of key 70 includes a tine 77 which is radially spaced from the shaft 72 and extends from the one key end generally parallel to the shaft in a direction toward the head 75 of key 70. The tine 77 extends axially a distance from the one key end a distance shorter than the distance between the cheeks as illustrated in FIG. 5. Also, as illustrated in FIG. 1, cheek head 16*a* has an elongated slot 82 therethrough adjacent the opposite end of cavity 38.

In order to close handcuff 10 hereof, jaw 12 is moved toward and its free end is moved between cheeks 16 and 18. Teeth 14 of jaw 12 will slide past the teeth 48 carried by bolt head 46 in a ratchet-like manner. When handcuff 10 is fully closed, bolt 40 is biased by spring 42 to maintain the teeth 48 of bolt 40 engaged with teeth 14 of jaw 12 thus locking handcuff 10 in its closed position and preventing movement of jaw 12 away from cheeks 16 and 18. This action provides a single lock for the handcuff 10.

To double lock the handcuff 10, bolt spring 42 is linearly displaced to the right from the position illustrated in FIG. 4 to the position illustrated in FIG. 3. To accomplish this, pin 76 on key 70 is inserted through slot 82 to engage behind bolt spring 42. Thus, by translating the key, spring 42 is displaced linearly along cavity 38 into the position illustrated in FIG. 3 to locate detent 62 in registry opposite head 56 of bolt 40. This prevents bolt 40 from pivoting toward an unlocked position with teeth 48 disengaged from teeth 14. Thus, the bias of spring 42 serves to maintain bolt 40 in the handcuff locked position illustrated in FIG. 3 while simultaneously detent 62 prevents bolt 40 from pivoting from its locking position vis-a-vis jaw 12 toward its unlocked position illustrated in FIG. 4. Thus, spring 42 serves as a double lock for handcuff 10.

To unlock handcuff 10 and enable jaw 12 and cheeks 16 and 18 to pivot about stud 20 in a direction away from one another, key 70 is inserted into key opening 59 about pin 69. Of course, the projection 74 on the key is first alined with the slot in the bushing prior to inserting the key. By rotating key 70, for example in a counterclockwise direction as indicated by the arrow in FIG. 3, projection 74 on key 70 engages flanges 64 at the end of second spring leg 68. Upon continued rotation of key 70 in that direction, bolt spring 42 is linearly displaced, for example from left to right in FIG. 1. This latter linear displacement misaligns detent 62 with head 46 such that the bolt head 46 registers with the space along spring leg portion 68 between detent 62 and flange 64. Thus, while the additional detenting action is removed, the bias of spring 42 urges bolt 40 into engagement with jaw 12 to maintain the handcuff in its single locked position. Once spring 42 is displaced as indicated, key 70 is then rotated in the opposite direction to bring tine 77 into engagement with shoulder 56 on bolt head 46. Continued rotation of the key 70 in that direction lifts or pivots bolt 40 to remove teeth 48 from engagement with teeth 14. Thus, jaw 12 is free for movement away from cheeks 16 and 18 whereby handcuff 10 may be opened.

From the foregoing, it will be appreciated that only the portion of tine 74 in circumferential registration with shoulder 56 upon rotation of the key lifts the bolt and that such portion is located between the inner end of the bushing and cheek 16. The remaining portion of the tine toward the end of the key and between the inner end of the bushing and cheek 18 does not have sufficient radial extent to engage the bolt because the bolt is recessed at that location. In the absence of a key having the illustrated shape, it is impossible for a tool or paperclip bent only at a right angle to operate the bolt. Thus, there is provided in accordance with the present invention improved protection against picking the lock of the handcuffs.

It will be apparent to those skilled in this art that various modifications could be made in the handcuff hereof without departing from the scope or spirit of the invention.

What is claimed is:

1. A handcuff comprising:

generally arcuate front and back cheeks spaced one from the other and carrying a lock assembly therebetween at one end, a generally arcuate jaw having teeth at one end, means for pivotally coupling said cheeks and said jaw one to the other at their respective opposite ends to enable relative pivotal movement of said cheeks and said jaw toward and away from one another between handcuff closed and open positions, respectively, said lock assembly including a bolt between said cheeks having teeth and pivotal between a locking position with its teeth engaging the teeth carried by said jaw to prevent relative movement of said cheeks and said jaw away from one another toward the handcuff open position and an unlocking position with its teeth spaced from the teeth carried by said jaw to enable relative movement of said cheeks and said jaw away from one another toward the handcuff open position, and a bolt spring carried by said lock assembly having a portion engageable with said bolt to bias said bolt for movement toward its locking position, one of said cheeks having an opening through a wall thereof for receiving the end of a key, a generally cylindrical bushing disposed in said opening with its inner end terminating short of the other of said cheeks, an axially extending slot in said bushing for receiving a key having a lateral projection thereon, a pin secured to said other cheek and extending therefrom into said bushing, said pin being spaced from said bushing to define an annular space therebetween for receiving the key, said bolt having a bolt end with a shoulder engageable by the lateral projection of the key for displacing the bolt from its locked position toward its unlocked position upon rotation of the key, said shoulder being located in the space between said cheeks and between the inner end of said bushing and said one cheek, the remaining portion of said bolt end between the inner end of said bushing and the other of said cheeks being recessed away from said bushing and said bushing slot being angularly displaced from the location of said shoulder thereby preventing direct access to said shoulder through said key opening.

2. A handcuff according to claim 1 including a key having a shaft, a head at one end of the shaft and said laterally extending projection at the opposite end of said shaft, said projection including a tine spaced from said shaft and extending from said opposite key end along said shaft toward said head, said tine being spaced from said shaft such that said tine is located outside said bushing and in the space between the inner end of said bushing and said one cheek upon rotation of said key, whereby said tine is engageable with said shoulder to unlock the handcuff upon rotation of said key.

* * * * *